United States Patent [19]

Duryea

[11] Patent Number: 4,882,485

[45] Date of Patent: Nov. 21, 1989

[54] ION DETECTOR AND ASSOCIATED REMOVABLE IONIZER INLET ASSEMBLY

[75] Inventor: Anthony N. Duryea, Cheswick, Pa.

[73] Assignee: Tracor, Inc., Austin, Tex.

[21] Appl. No.: 255,137

[22] Filed: Oct. 7, 1988

Related U.S. Application Data

[63] Continuation of Ser. No. 83,376, Aug. 10, 1987, which is a continuation of Ser. No. 898,839, Aug. 20, 1986, abandoned, which is a continuation of Ser. No. 676,068, Nov. 29, 1984.

[51] Int. Cl.[4] ..... H01J 49/04

[52] U.S. Cl. ..... 250/288; 73/864.81

[58] Field of Search ..... 250/288, 288 A; 73/864.81

[56] References Cited

U.S. PATENT DOCUMENTS 2,882,410 4/1959 Brobeck ..... 250/288
3,073,951 1/1963 Burdg ..... 250/288
3,590,243 6/1971 Perrin et al. ..... 250/288
4,298,795 11/1981 Takeuchi et al. ..... 250/288 A
4,454,894 6/1984 Tallon ..... 250/288

*Primary Examiner*—Jack I. Berman
*Attorney, Agent, or Firm*—Arnold B. Silverman

[57] ABSTRACT

An improved ion detector having a removable ionizer inlet assembly, a high vacuum chamber, an analyzer and a removable detector are provided. Valves are employed to permit replacement of the ionizer inlet assembly or the detector without meaningful loss of vacuum. The ionizer inlet assembly has a gap which is adjustable in order to permit more precise control of the molecules which are delivered to the ionizer. Adjustment is provided to control ions which are discharged from the ionizer assembly prior to delivery to the analyzer. Internal heating is provided for the ionizer inlet assembly zones. The ionizer preferably has generally longitudinally oriented slots to facilitate more efficient electron bombardment of the molecules.

29 Claims, 4 Drawing Sheets

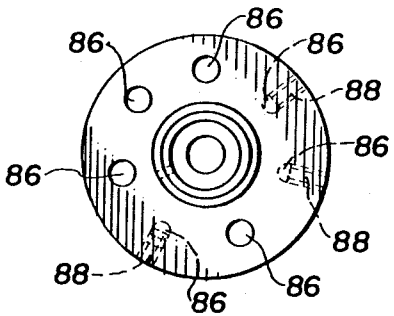
FIG. 5
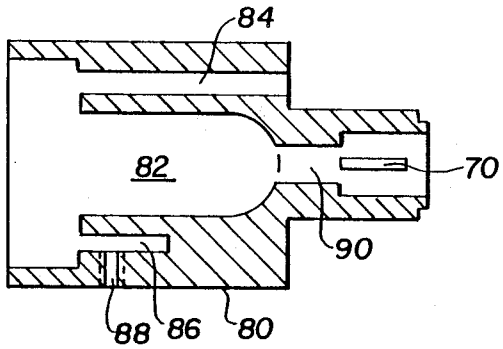
FIG. 3
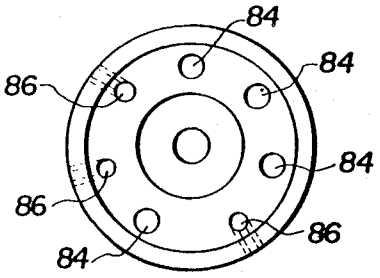
FIG. 4
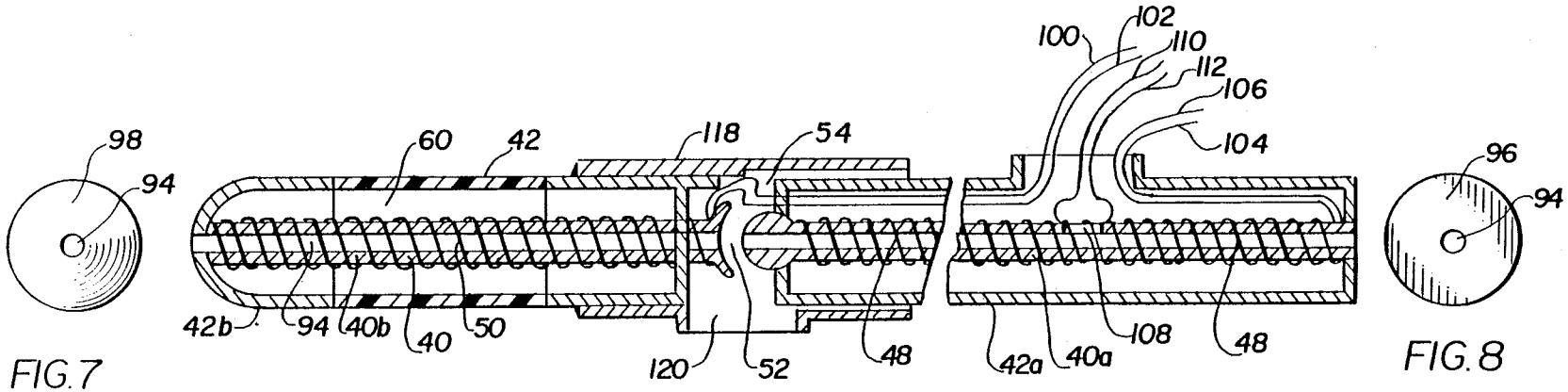
FIG. 8
FIG. 6
FIG. 7

ION DETECTOR AND ASSOCIATED REMOVABLE IONIZER INLET ASSEMBLY

This application is a continuation of application Ser. No. 083,376 filed Aug. 10, 1987, which is a continuation of Ser. No. 898,839, filed Aug. 20, 1986, abandoned, which in turn was a continuation of Ser. No. 676,068, filed Nov. 29, 1984.

BACKGROUND OF THE INVENTION

1. Field of the Invention.

The present invention relates to an improved ion detector and, more specifically, it relates to such a detector which has means which permit the ionizer inlet assembly and the detector assembly to be removed as a unit without meaningful loss of vacuum from the detector.

2.DESCRIPTION OF THE PRIOR ART

The use of mass spectrometers in determining the identity and quantity of constituent materials present in a gaseous, liquid or solid specimen has long been known. It has been known in connection with such systems to, under vacuum, analyze a specimen through conversion of the molecules into ionic form and permitting the ions to bombard a detector. See generally U.S. Pat. Nos. 2,882,410; 3,073,951; 3,590,243; and 4,298,795.

Among the shortcomings of the prior art as exemplified by the hereinbefore identified patents is the fact that they are not designed to have an ionizer inlet assembly probe removed from and introduced into the apparatus without significant loss of vacuum. The same is true with respect to the detector assemblies used in such systems. Replacement of either has generally resulted in a substantial amount of work and a significant loss of time.

While U.S. Pat. No. 4,454,894 discloses a gas bleed cock, there is lacking in the present environment a teaching of a system which permits elimination of certain portions of a specimen such as a carrier gas, such as helium, prior to introduction of the specimen into the ionizer. There is also lacking a system which permits precise control and adjustment of such discharge apparatus.

There remains, therefore, a very real and substantial need for an improved ion detector and for such a detector which permits removal of components without undesired loss of vacuum.

SUMMARY OF THE INVENTION

The present invention has solved the above-described problems. In the present invention, an ion detector has an ionizer inlet assembly which is adapted to be removed or restored to the remaining portions of the detector without undesired loss of vacuum. This is accomplished by the use of valve means. Similarly, ready replacement of the detector assembly may be accomplished without undesired loss of vacuum in the apparatus.

A high vacuum chamber contains an analyzer assembly and is operatively associated with the ionizer inlet assembly and the detector means.

The ionizer inlet assembly preferably has an inner tube which is adapted to transport the molecules and a radially outwardly spaced surrounding outer tube. A gap is provided in each of these tubes in order to permit diversion of a portion of the molecular stream prior to introduction of the same into the ionizer. Means which may take the form of bellows means are provided to permit precise adjustment of the amount of opening in the gaps in order to control the amount of molecules diverted.

A male portion of the ionizer inlet assembly is adapted to be introduced into a female portion of the ionizer. The ionizer preferably has at least one circumferentially disposed longitudinally oriented slot for the passage of bombarding electrons therethrough.

Electrical resistance heating means, or other types of heating means, may be provided internally within the ionizer inlet assembly in order to permit the desired heating. Several longitudinally defined zones may provide different heating to different sectors of the inner tube. The inner tube and outer tube preferably have glass walls in order to avoid undesired contact between the molecules an metal during processing.

It is an object of the present invention to provide an ion detector and ionizer inlet assembly for use therein which will permit removal of the latter from the former without breaking the vacuum and also will provide a detector assembly which similarly permits removal without undesired loss of vacuum.

It is another object of the present invention to provide an ion detector which is of relatively small size thereby reducing the capital investment in pumps and the amount of time required to establish a high vacuum level in the high vacuum chamber.

It is another object of the present invention to provide such apparatus which is economical to manufacture and use and which is adapted for easy maintenance and use.

It is another object of the present invention to provide such an ionizer inlet assembly which has internal heating.

It is a further object of the present invention to provide such apparatus wherein a physical break in the ionizer inlet assembly permits diversion of molecules which are not to be delivered to the ionizer.

It is a further object of the present invention to provide such a system which resists direct contact between the molecules to be analyzed and metallic components of the system.

These and other objects of the invention will be more fully understood from the following description of the invention on reference to the illustrations appended hereto.

BRIEF DESCRIPTION OF THE DRAWINGS

FIG. 3 is a cross sectional illustration of the ionizer of the present invention.

FIG. 4 is a left-hand elevation of the ionizer of FIG. 3.

FIG. 5 is a right-hand elevation of the ionizer of FIG. 3.

FIG. 6 is a cross sectional illustration, partly schematic showing a portion of the ionizer inlet assembly with the heating means.

FIG. 7 is left-hand elevational view of the ionizer inlet assembly of FIG. 6.

FIG. 8 is a right-hand elevational view of the ionizer inlet assembly of FIG. 6.

DESCRIPTION OF THE PREFERRED EMBODIMENTS

Figure 1:
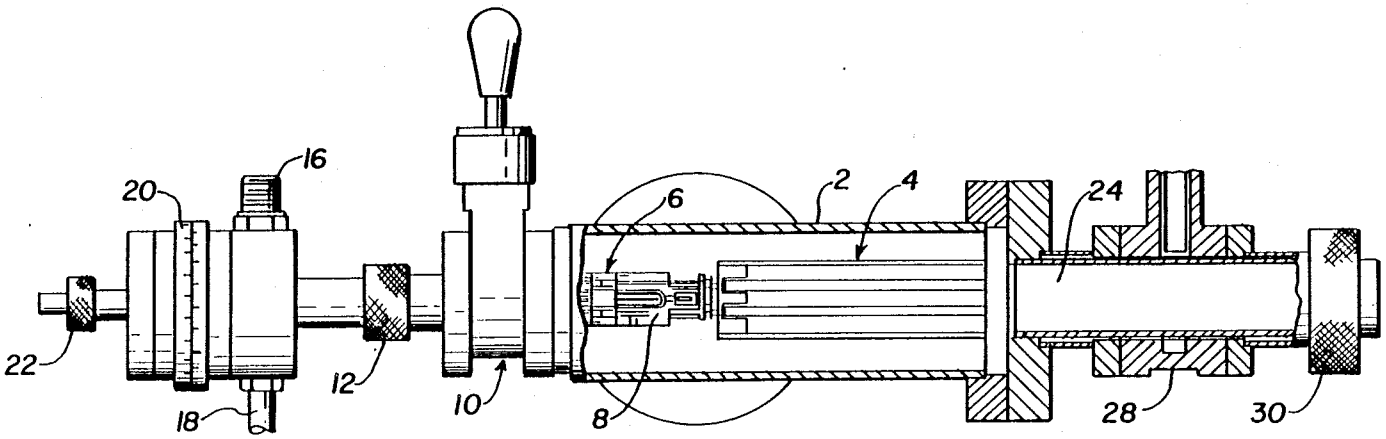
FIG. 1 is an elevational view, partly in section, showing a form of ion detector of the present invention.

Referring now more specifically to FIG. 1, there is shown a preferred embodiment of the ion detector of the present invention. A high vacuum chamber 2 contains an analyzer 4 which is operatively associated with the ionizer 8 and the ionizer inlet assembly 6 which is adapted to introduce the specimens to be analyzed in a fashion to be discussed hereinafter. The specimen while generally of a gaseous nature may also be liquid if desired or be a gas in which has been entrained particles of a liquid.

A valve 10 which may be a gate valve, is adapted to have the ionizer inlet assembly 6 pass therethrough and serves to permit removal of the assembly 6 from the rest of the ion detector without breaking the vacuum contained within the high vacuum chamber 2. A quick disconnect member 12 serves to facilitate removal of the ionizer inlet assembly from the remainder of the apparatus. Electrical connector 16 serves to energize the ionizer inlet assembly 6. Connection 18 is a vacuum line which may be secured to a vacuum pump. Adjustment means 20 serve to permit precise adjustment of the extent of gap defined between axial sectors of the walls of the ionizer inlet assembly.

A further quick disconnect member 22 is provided. On the other side of the analyzer 4 and high vacuum chamber 2 is a detector housing 24 which is also adapted to be removed without meaningful loss of vacuum from the high vacuum chamber 2. Valve 28 which may be substantially identical to valve 10 and may be a gate valve may be employed for this purpose. Quick disconnect member 30 is provided.

Figure 2:
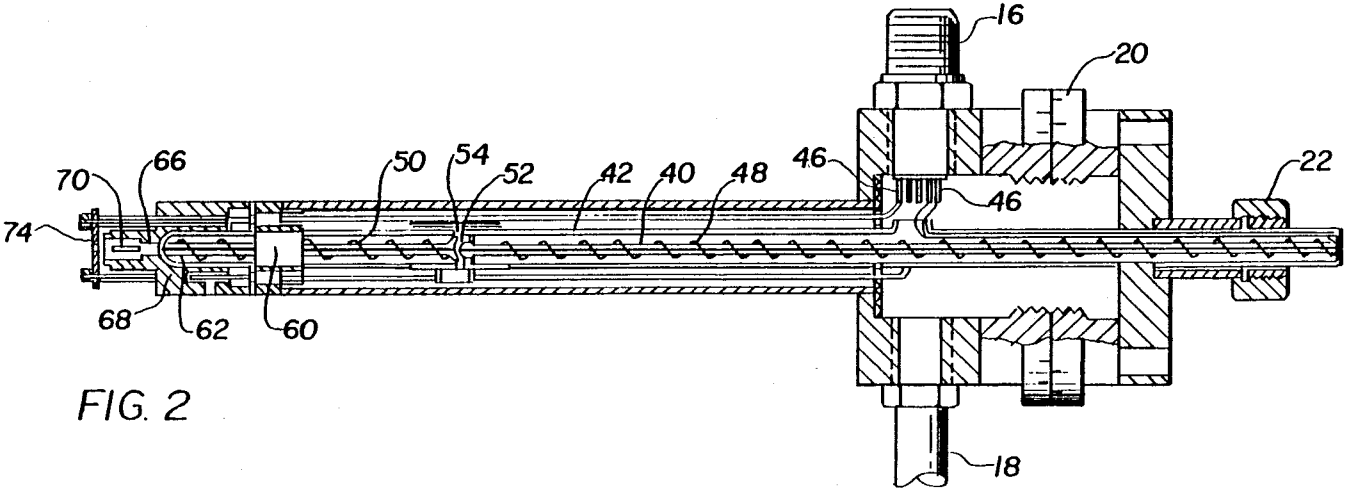
FIG. 2 is a cross sectional illustration of the ionizer inlet assembly or probe of the present invention.

Referring to FIG. 2, there is shown a cross section which illustrates certain preferred features of the ionizer inlet assembly 6 and the ionizer 8. The inner tube 40 has an axial bore through which molecules to be ionized will pass. This inner tube 40 is preferably made of glass. A feature of the present invention is the fact that the molecules to be analyzed are preferably kept out of contact with metal components of the assembly during passage through the ionizer inlet assembly. An outer tube 42 is disposed in spaced relationship with respect to inner tube 40 and preferably has a glass wall. It will frequently be desirable for purposes of structural integrity to provide an additional metal wall around the outer tube 42 disposed exteriorly of the glass wall. A plurality of terminals 46 are electrically connected to connector 16 and have a plurality of contacts used for purposes to be described hereinafter.

One of the features of the present invention is the elimination of the need for external heating of the ionizer inlet assembly. In the present invention, heating means such as electrical resistance wires 48, 50 are wound in a helical path about the exterior of inner tube 40. These are energized through leads which are connected to terminals 46. In the preferred embodiment, several independent connections will be effected in order to permit heating of different zones of inner tube 40 to different temperatures.

Another feature of the invention which may best be seen with reference to FIGS. 2 and 6 is the gap 52 which is provided in the inner tube 40 and the associated gap 54 which is provided in the outer tube 42. These gaps 40, 52 which in the preferred form are adjustable as to size permit a portion of the molecules to be diverted so as not to continue down the bore 94 of inner tube 40 and thereby avoid their becoming ionized and involved in the analysis process. For example, frequently helium will be employed as a carrier gas to transport the molecules to be analyzed. By appropriate settings of the gaps 52 and 54 one may cause the helium to be discharged through outlet 120 (FIG. 6). In the preferred embodiment of the invention, an adjustable bellows member 20(FIGS. 1 or 2) may be employed so as to permit opening or closing movement of the inner and outer tube so as to adjust the width of gaps 52, 54. The bellows member is linked to the quick disconnect 22 which compresses a 0-ring around the outer glass tube 42. It will be appreciated from FIG. 6 that the outer tube has sections 42*a* and 42*b* and the inner tube has sections 40*a* and 40*b* which are subjected to relative opening and closing movement responsive to adjustment of the bellows 20. Two slip rings are mounted around the bellows between the flange. When the rings are rotated with respect to one another an angle is created between the flange thereby enabling the glass tube feedthrough mounted on the flange to vary with respect to the centerline of the port on the chamber.

Referring once again to FIG. 2 there is shown an insulating washer 60 which may be conveniently composed of ceramic material so as to provide the desired thermal and electrical insulation between the ionizer 8 and inlet assembly body 42. This insulating member serves to provide the desired electrical separation between zones.

It is noted that the male portion 62 of the ionizer inlet assembly is received within the female portion 68 of the ionizer 66. It is noted that as is shown in FIGS. 2 and 3 the ionizer 66 has at least one elongated slot 70 disposed rearwardly of the female portion. In a preferred embodiment two slots 70 will be disposed on diametrically opposed sides. These slots which are preferably circumferentially positioned and longitudinally oriented serve to facilitate introduction of the bombarding electrons which generate the ions when they contact the molecules. If desired, the slots may be positioned at a relatively small angle with respect to the longitudinal orientation, however, the longitudinal orientation is preferred. As is shown in FIG. 2, lens member 74 which is preferably composed of stainless steel and serves to direct the path of the ions into the analyzer. Also, due to the movement of the probe assembly adjustment of the distance between the analyzer 4 and the lens 74 is adjustable with a forward to backward movement thereby optimizing ion intensity from the ionizer 8 into the analyzer.

Details of the ionizer are shown in FIGS. 3–5. The female portion 80 has the recess 82 which receives the male portion 62 of the ionizer inlet assembly. The female portion has a plurality of passageways 84 which pass completely therethrough and a plurality of passageways 86 which extend partially therethrough. Pin members (not shown in these figures) pass into these passageways 84, 86 to serve to index the ionizer inlet assembly with respect to the ionizer 8 and fasteners (not shown) are introduced into bore 88 to secure the same in the desired position with a desired extent of penetration. It will be noted that as the molecules pass from the inner tube bore 94 into the female member, they will pass through restricted passageway 90 into the region of slots 70 where they may be bombarded by electrons passing through slots 70. The resultant ions will enter the high vacuum chamber 2, pass into analyzer 4 and will subsequently impinge upon the detector means 24.

As is shown in FIGS. 6–8, end walls 96, 98 are provided in the ionizer inlet assembly. A thermocouple 108 which is adapted to determine the temperature of a zone of the ionizer inlet assembly is measured by wires 110, 112. Wires 100, 102 energize the electrical resistance wires covering portion **40*b* of the inner tube 40 and wires 104, 106 energize the resistance wires covering portion 40*a* of the inner tubes. Pins of 140 monitor through temperature sensor the temperature of 40*b* and the ionizer 8**.

Figure 9:
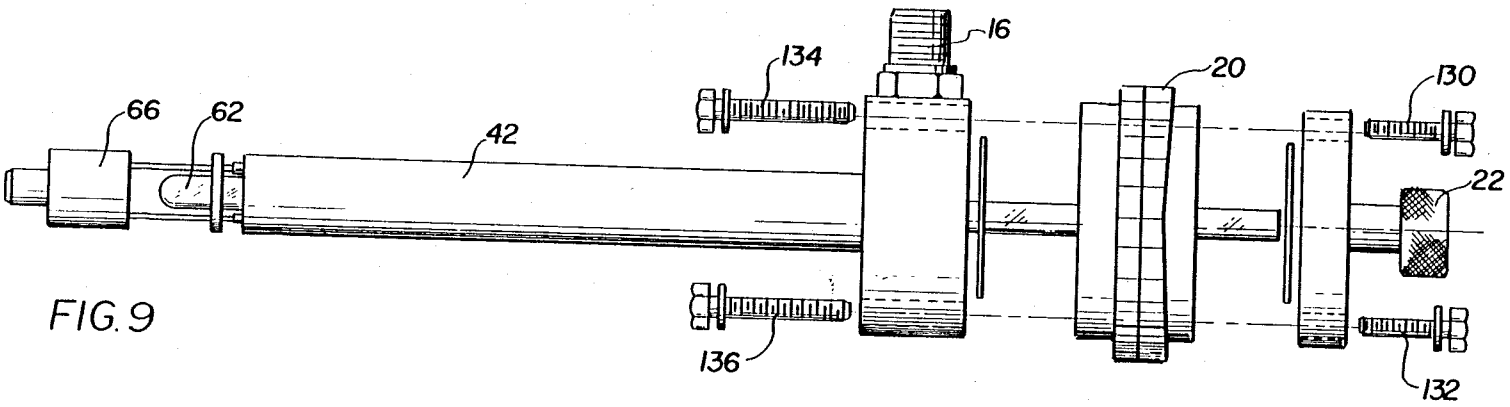
FIG. 9 is an exploded view showing a portion of the ionizer inlet assembly.

FIG. 9 shows an exploded view of a portion of the assembly illustrating bolts 130, 132, 134, 136 which secure the assembly in desired position.

Figure 10:
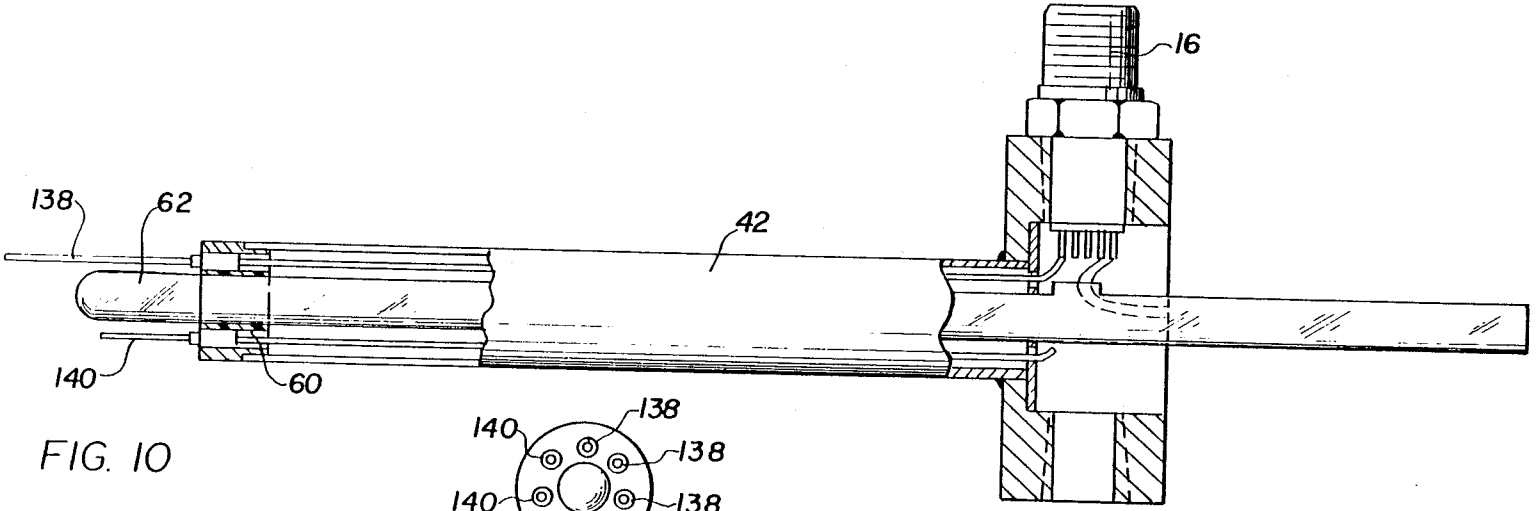
FIG. 10 is a partly broken away illustration showing portions of the ionizer inlet assembly.
Figure 11:
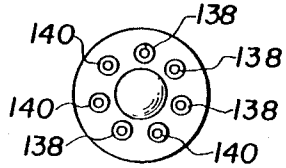
FIG. 11 is a left-hand elevational view of the assembly shown in FIG. 10.

FIGS. 10 and 11 illustrate the electrically energized pins 138, 140 which project outwardly from the ionizer inlet assembly and are engaged within the sockets of the ionizer. These pins serve both as mechanical retaining mean and as filaments for generating electrons which bombard the molecules. In the form illustrated, four of the longer pins 138 which project entirely through the ionizer 8 have been employed and three of the other or shorter pins are provided.

Figure 13:
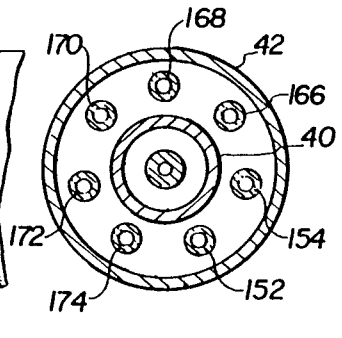
FIG. 13 is a cross-sectional illustration taken through 13—13 of FIG. 12.
Figure 12:
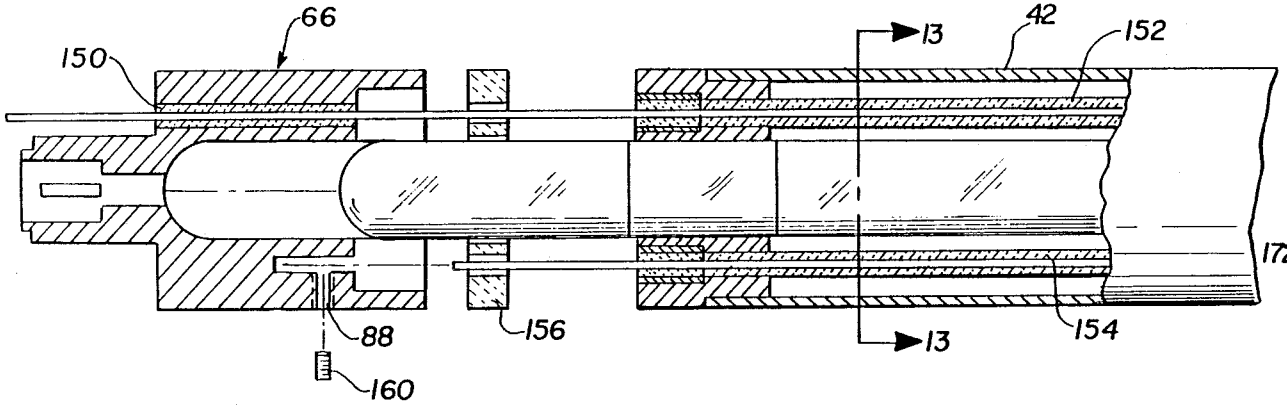
FIG. 12 is a partially schematic illustration showing how portions of the ionizer inlet assembly interfit with the ionizer.

Further details are illustrated in FIGS. 12 and 13 wherein it is shown that electrical insulators 150, 152, 54, 166, 168, 170, 172, 174 serve to surround the pin members. Also, fasteners 160 extend into the passageways 88 to secure the shorter electrical pins in place.

It will be appreciated, therefore, that the present invention has solved a number of significant problems in respect of ion detectors.

Among the advantageous features of the present invention are the ability to make the ion detector of relatively small dimensions. For example, the ionizer inlet assembly or removable probe may have an overall length of about 9 to 12 inches and the overall assembly may have an overall length of about 15 to 18 inches.

The diameter of the ionizer inlet assembly may be about $\frac{3}{4}$ to $\frac{7}{8}$ inches. As a result, a relatively small volume needs to be evacuated and a single pump may be employed to evacuate this relatively small region as contrasted with multiple pumps generally required with the prior art systems.

It will be appreciated, therefore, that the present invention provides a solution to a number of problems in this area. Rather than requiring disassembly of the system, loss of vacuum and a large amount of time, the present system contemplates removal or replacement of either ionizer inlet assemblies or detectors or both while avoiding meaningful loss of vacuum. In addition, internal heating means are provided to establish efficient control of the temperature and permit different zones to have different temperatures. Further, the interrelationship between the male and female members are such as to provide for precise indexing of the members. In addition the gaps in the ionizer inlet assembly tubes, which gaps are preferably adjustable, permit one to divert the molecules which need not be delivered to the ionizer. All of this permits an economical, efficient and easy-to-use system which is adapted for highly accurate determinations.

Whereas particular embodiments of the invention have been described above for purposes of illustration, it will be evident to those skilled in the art numerous variations of the details may be made without departing from the invention as defined in the appended claims.

I claim:

1. An ion detector comprising an ionizer inlet assembly, a high vacuum chamber partially receiving said ionizer inlet assembly, an analyzer assembly disposed within said high vacuum chamber and adapted to receive ions from said ionizer, detector means for receiving ions from said ionizer, and said ionizer inlet assembly having an inner tube and an outer tube spaced radially outwardly from said inner tube, said inner tube having a gap for discharge of a portion of the material transported therein, and said outer tube having a gap for discharge of the material discharged from said inner tube through said inner tube gap, means for adjusting the gap in said inner tube while said ion detector is operating to regulate the volume of material discharged therefrom whereby a portion of the said material will be discharged without entering said analyzer and the performance of said ionizer can be optimized, and valve means associated with said ionizer inlet assembly, whereby said ionizer inlet assembly may be removed from said high vacuum chamber without meaningful loss of of vacuum therein.

2. The ion detector of claim 1 including a female ionizer receiving a male portion of said ionizer inlet assembly.

3. The ion detector of claim 2 including said ionizer inlet assembly having an inner tube and an outer tube spaced radially outwardly from said inner tube.

4. The ion detector of claim 3 including said inner tube having a gap for discharge of a portion of the material transported therein, and said outer tube having a gap for discharge of the material discharged from said inner tube through said inner tube gap.

5. The ion detector of claim 4 including means for adjusting the gap in said inner tube to regulate the volume of material discharged therefrom.

6. The ion detector of claim 5 including said adjustment means having bellows.

7. The ion detector of claim 3 including heater means disposed within said ionizer inlet assembly.

8. The ion detector of claim 7 including said electrical heater means having electrical wires disposed intermediate said inner tube and said outer tube.

9. The ion detector of claim 8 including said electrical heater means having at least two zones adapted to be maintained at different temperatures.

10. The ion detector of claim 1 including said valve means having first valve means operatively associated with said high vacuum chamber, and said ionizer inlet assembly passing partially through said valve means, whereby said first valve means may be closed after removal of said ionizer inlet assembly to resist loss of vacuum in said high vacuum chamber.

11. The ion detector of claim 10 including said first valve means being disposed adjacent to said high vacuum chamber and adapted to have said ionizer inlet assembly pass therethrough into said high vacuum chamber.

12. The ion detector of claim 10 including second valve means operatively associated with said high vacuum chamber and being disposed on the other side of said chamber from said first valve means, said second valve means adapted to have said detector means extending therethrough, whereby said second valve means may be closed after removal of said detector means to resist loss of vacuum in said high vacuum chamber.

13. The ion detector of claim 12 including said inner tube and said outer tube having glass walls.

14. The ion detector of claim 13 including said outer tube having a metal wall.

15. The ion detector of claim 2 including said ionizer having at least one circumferentially disposed longitudinally oriented slot.

16. The ion detector of claim 15 including pin means projecting from said ionizer inlet assembly to index said ion inlet assembly with respect to said ionizer.

17. The ion detector of claim 16 including at least some of said pin means passing through said ionizer to engage said analyzer.

18. The ion detector of claim 15 including said ionizer having at least two said slots.

19. The ion detector of claim 15 including the bore of said inner tube being generally aligned with said ionizer bore, whereby molecules traveling through said inner tube bore will pass into said ionizer for creation of the ions to pass into said analyzer.

20. The ion detector of claim 15 including said ionizer having a lens, and means for adjusting the distance between said lens and said analyzer assembly.

21. A removable ionizer inlet assembly for ion detectors comprising an inner tube for transporting molecules, an outer tube disposed in spaced relationship with respect to said inner tube, a first gap formed within said inner tube, and a second gap formed within said outer tube, whereby molecules may be discharged from said inner tube through said first gap, and adjusting means for altering the amount of opening in said first gap during operation of said ion detector, whereby the performance of said ionizer can be optimized.

22. The removable ionizer inlet assembly of claim 21 including adjusting means for altering the amount of opening in said first gap.

23. The removable ionizer inlet assembly of claim 22 including heater means disposed within said assembly for heating the same.

24. The removable ionizer inlet assembly of claim 22 including said adjustment means including bellows means.

25. The removable ionizer inlet assembly of claim 23 including said heater means having electrical resistance wires disposed externally of said inner tube.

26. The removable ionizer inlet assembly of claim 25 including said electrical wires having independent heating zones for heating different axial portions of said ionizer inlet assembly to different temperatures.

27. The removable ionizer inlet assembly of claim 26 including said assembly adapted to be sealed as a unit.

28. The removable ionizer inlet assembly of claim 26 including said inner tube and said outer tube each having walls made of glass and said outer tube having an additional wall made of metal.

29. The removable ionizer inlet assembly of claim 26 including said ionizer inlet assembly having a projecting male portion adapted to be received within a female portion of an ionizer.

* * * * *